US005860289A

United States Patent [19]

Wetzel

[11] Patent Number: 5,860,289

[45] Date of Patent: Jan. 19, 1999

[54] OPEN FLORAL DISPLAY CASE

[75] Inventor: Michael L. Wetzel, Skaneateles, N.Y.

[73] Assignee: Floratech Industries, Inc., Syracuse, N.Y.

[21] Appl. No.: 955,224

[22] Filed: Oct. 22, 1997

[51] Int. Cl.[6] ..... A47F 3/04

[52] U.S. Cl. ..... 62/255

[58] Field of Search ..... 62/255, 256; 454/193

[56] References Cited

U.S. PATENT DOCUMENTS

| | | | |
|---|---|---|---|
| 2,050,063 | 8/1936 | Millott | 62/89.5 |
| 2,279,484 | 4/1942 | Monshower | 62/89.5 |
| 2,492,695 | 12/1949 | Henderson | 62/255 |
| 2,495,554 | 1/1950 | Spangler | 62/255 |
| 2,528,916 | 11/1950 | Shreve | 62/89.5 |
| 2,630,684 | 3/1953 | Strang | 62/89.5 |
| 2,822,672 | 2/1958 | Dickson et al. | 62/89.5 |
| 2,936,596 | 5/1960 | Rainwater | 62/251 |
| 3,056,274 | 10/1962 | Pouchert | 62/418 |
| 3,229,475 | 1/1966 | Balk et al. | 62/256 |
| 3,289,432 | 12/1966 | Brennan et al. | 62/256 |
| 3,304,736 | 2/1967 | Brennan et al. | 62/176 |
| 3,369,375 | 2/1968 | Gerwick et al. | 62/256 |
| 4,338,792 | 7/1982 | Ibrahim | 454/193 |
| 4,373,355 | 2/1983 | Monroe | 62/256 |
| 4,457,139 | 7/1984 | Ibrahim | 62/256 |
| 4,458,501 | 7/1984 | Kooy | 62/256 |
| 4,608,776 | 9/1986 | Kooy | 47/58 |
| 4,608,835 | 9/1986 | Kooy | 62/255 |
| 4,630,451 | 12/1986 | Kishimoto | 62/247 |
| 4,680,942 | 7/1987 | Kooy | 62/256 |
| 4,760,708 | 8/1988 | Karashima | 62/256 |
| 4,953,363 | 9/1990 | Primozic | 62/255 |
| 5,345,778 | 9/1994 | Roberts | 62/256 |
| 5,357,767 | 10/1994 | Roberts | 62/256 |
| 5,502,979 | 4/1996 | Renard | 62/256 |

*Primary Examiner*—William E. Tapiocal
*Attorney, Agent, or Firm*—Trapani & Molldrem

[57] ABSTRACT

A refrigerated open display case achieves a laminar flow of chilled air over flowers or produce displayed therein, and establishes a laminar flow boundary layer with the warmer ambient air. There is an array of perforations serving as chilled air supply openings on each of the vertical riser walls, so that the chilled air is discharged in a laminar flow. A return air intake grille extends across the cabinet below the front of the lowermost shelf, in an undercut transverse recess. The front part of the lowermost shelf member can have a chamfer or downward slope, so that debris that falls on it drops to the floor in the front of the cabinet, where it can be routinely swept up. The recess below this chamfer can likewise have a slanting lower wall. Inside the cabinet, the coldest air leaving the evaporator coil passes in contact with the underside of the shelf members, so these shelf members are also kept chilled. Vases or flower containers, which can be metal, are positioned in open receptacles in the shelves, with the bottoms of the vases or containers projecting down into the cold air tunnel.

14 Claims, 3 Drawing Sheets

OPEN FLORAL DISPLAY CASE

BACKGROUND OF THE INVENTION

The invention concerns a refrigerated display case or merchandiser for cut flowers or other merchandise. The invention is more particularly concerned with a floral display case which achieves lamninar flow of cooling air over the cut flowers in the case, and which, with an open top and open front, and with a low profile, creates an improved presentation, as well as improved preservation of the flowers or other merchandise.

Refrigerated display cases are frequently used in markets for presenting merchandise that must be kept cold, such as dairy products. In the case of floral merchandisers or display cabinets, there have been a number of open refrigerated display cases proposed, and several of these appear in U.S. Pat. Nos. 4,608,835; 4,608,776 and 4,680,942. In each case, the cabinet contains refrigeration equipment for chilling air that circulates through, and there is an open display portion, in which vases or containers are seated in openings or receptacles in shelves. In each case, there is a top wall over the shelves of flowers, and refrigerated air flow is directed downwards from a top grating in the top wall down to a return grating inside the cabinet, at the inner wall of the front of the cabinet. The downward flow of air requires that the cold air be pumped or blown up to the top wall. The need for this top wall increases the height and weight of the display unit, and also creates a somewhat less inviting presentation to the customer.

Also, in the display cases of the prior art, the return air intake grating, being positioned at the base and at the inside of the cabinet, collects flower petals, dead leaves and other debris, which can affect the operation of the unit, and which require special cleaning. Some of these drop through and collect in the drain pan below the evaporator coil. In addition, positioning the return intake inside the cabinet makes it impossible for the unit to pick up chilled air that spills out the open front, thereby limiting the recirculation and limiting efficiency of the unit. This also increases the amount of warm air that is sucked into the unit.

OBJECTS AND SUMMARY OF THE INVENTION

Accordingly, it is an object of this invention to provide a refrigerated floral display case that avoids the drawbacks of the prior art, and which creates an open, inviting presentation of the flowers or other merchandise to customers.

It is another object to provide a refrigerated floral display case in which chilled air proceeds in a laminar flow from behind the flowers, then downwards, thereby gently bathing the flowers in cool air.

It is a further object of the invention to provide a laminar flow refrigerated display case which can have a low profile as compared with other refrigerated display cases of similar capacity.

It is a still further object to provide a display case in which petals, leaves, plant parts, or other debris fall harmlessly outside the cabinet and do not fall into the cabinet nor block the air flow through the return grille.

According to an aspect of this invention, a refrigerated open floral display case produces a laminar flow of chilled air over the flowers displayed therein, and establishes a laminar flow boundary layer. The case has a cabinet having a back, sides and an open front display portion, the front display portion including a plurality (e.g., three to five) of horizontal shelf members arranged in parallel staggered stair-step fashion. Vertical riser walls are disposed respectively behind the horizontal shelf members and connect between successive ones of said shelf members.

Refrigeration equipment within the cabinet produces a continuous, recirculating laminar flow of chilled air over the shelf members. There is a return air intake grille disposed across the cabinet below the front of a lowermost one of the shelf members, and on the outer side of the cabinet. The refrigeration equipment has a heat exchanger, i.e., an evaporator coil, that chills the air that enters said return air intake, and a fan or blower moves the air in a channel within the cabinet to chilled air supply openings arranged across each of the vertical riser walls, so that the chilled air is discharged in a laminar flow path over said shelves towards said return air intake. The air then is drawn in through the return air grille, and is recirculated through the evaporator coil and the supply openings.

The return air intake is formed as a recess extending transversely below the front of the lowermost shelf member and the return air grille is disposed in an undercut transverse wall of this recess. The front part of the lowermost shelf member can have a chamfer or downward slope, so that debris that falls on it drops to the floor in the front of the cabinet, where it can be routinely swept up. The recess below this chamfer can likewise have a slanting lower wall that meets the undercut transverse wall. This also ensures that any debris that is blown towards the return air intake grill drops to the floor in front of the cabinet.

Inside the cabinet, the chilled air proceeds from the evaporator coil through a cold air tunnel defined between the shelf members and a partition disposed beneath the shelf members. Thus the coldest air, that is, the air leaving the evaporator coil, passes in contact with the underside of the shelf members, so these shelf members are also kept chilled. This ensures that the air flow leaving the supply openings will hug the surfaces of the shelves, and flow nonturbulently past the flowers.

Vases or flower containers, are positioned in open receptacles in the shelves, with the bottoms of the vases or containers projecting down into the cold air tunnel. Thus the cold air flow keeps the vases, and water contained in them, cool to prolong flower freshness. The water in the vases or containers stays cold, and acts as a heat sink. This maintains the cold air flow when the refrigeration ceases, for example, when the unit goes into a defrost cycle. Thus this arrangement eliminates significant temperature increases in the air flow over the flowers, produce, or other merchandise.

Preferably, the vertical riser walls each have a multiplicity of chilled air supply openings evenly distributed on them in a two-dimensional array, so that the air leaving the supply openings creates a gentle, laminar flow.

On one or both sides of the cabinet there can be side walls, which can be glass or clear plastic, or can be clear, frosted, opaque or mirrored. These side walls can have a curved edge of a shape that approximates a quarter of an ellipse, and conforms with the boundary layer of the laminar flow from the uppermost supply openings into the return intake.

The refrigerated merchandise display case of this invention can maintain a low-velocity, laminar flow within the display case to protect and preserve products that are sensitive to temperature, humidity, and air velocity. Flowers will degenerate more rapidly if exposed to high air flow, even if the temperature and humidity are correct, due to stress on the fibers of the petals, leaves, and stems from the motion caused by the air flow. Dehydration is also accelerated by high air flow. Many other fresh and fresh-cut products experience this same problem. That is, the merchandise display case of this invention provides improved protection for products subject to dehydration, such as cut flowers, which can experience weakness of stems and petals. Other sensitive products, such as fruit, cheeses, or sliced food products, can enjoy improved shelf life from the arrangement of this invention.

The above and many other objects, features, and advantages of this invention will become apparent from the ensuing detailed description of a preferred embodiment, which should be read in conjunction with the accompanying Drawing.

DETAILED DESCRIPTION OF THE PREFERRED EMBODIMENT

Figure 1:
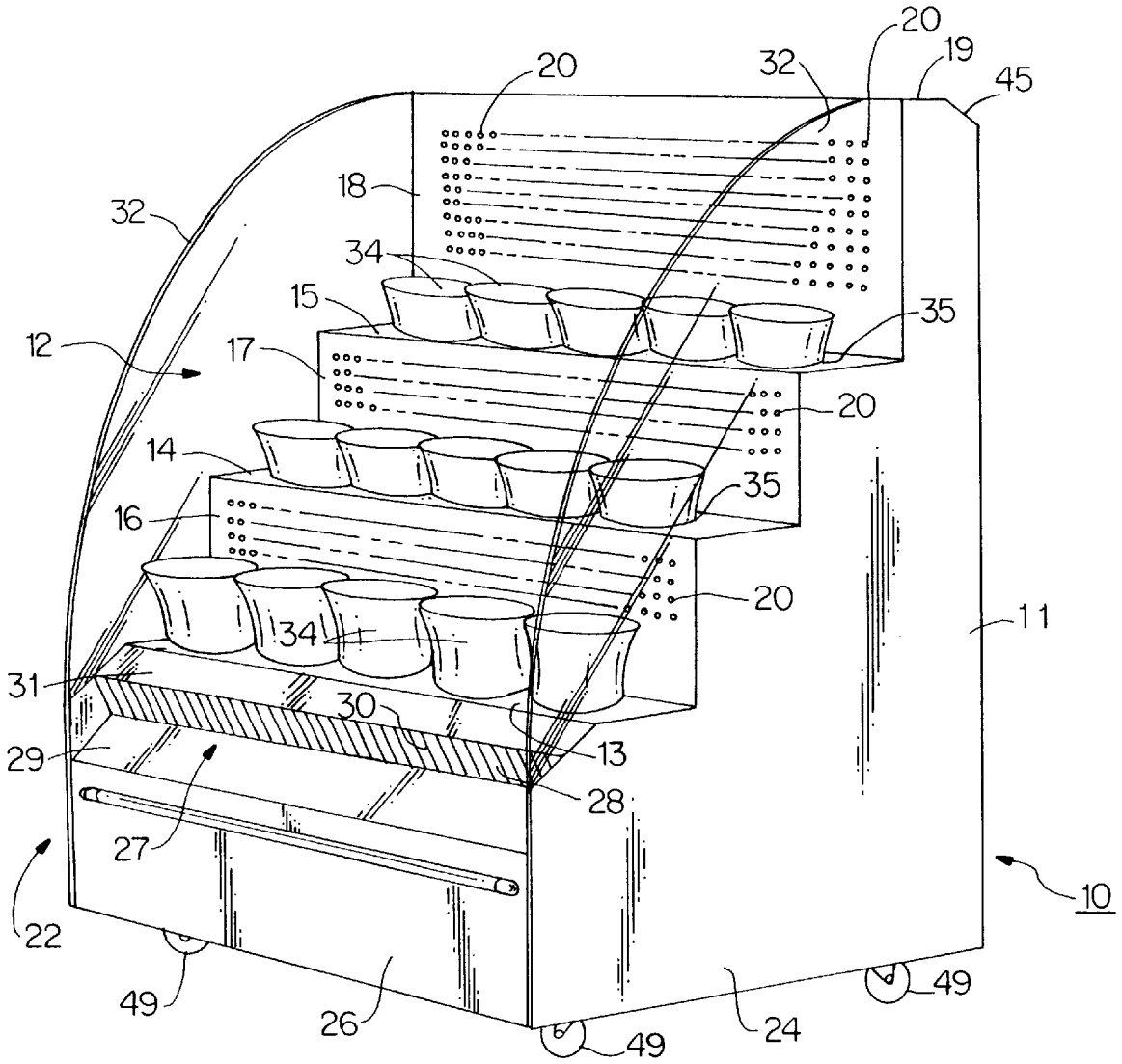
FIG. 1 is a perspective view of a refrigerated floral display unit according to one embodiment of this invention.
Figure 2:
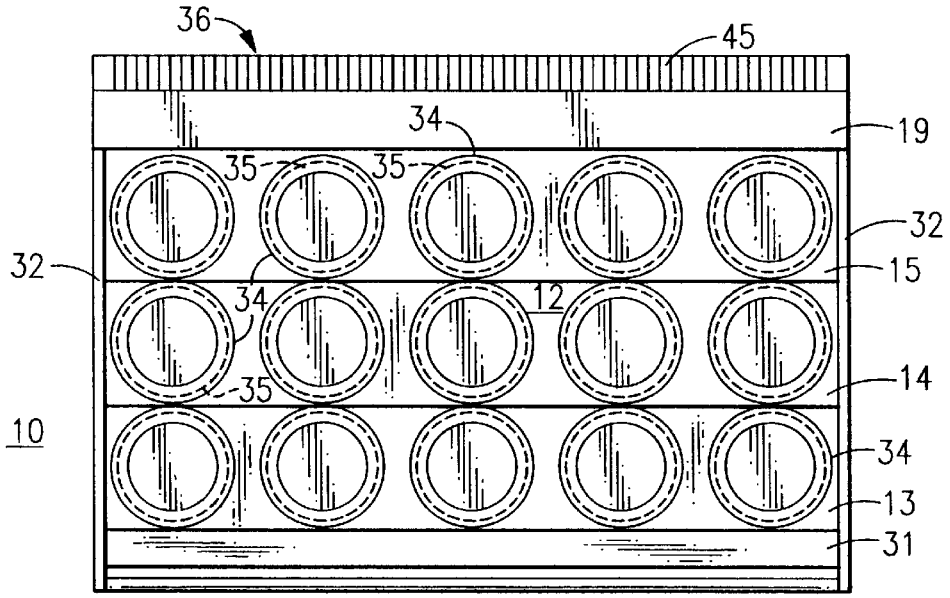
FIG. 2 is a to plan view of the unit of this embodiment.
Figure 3:
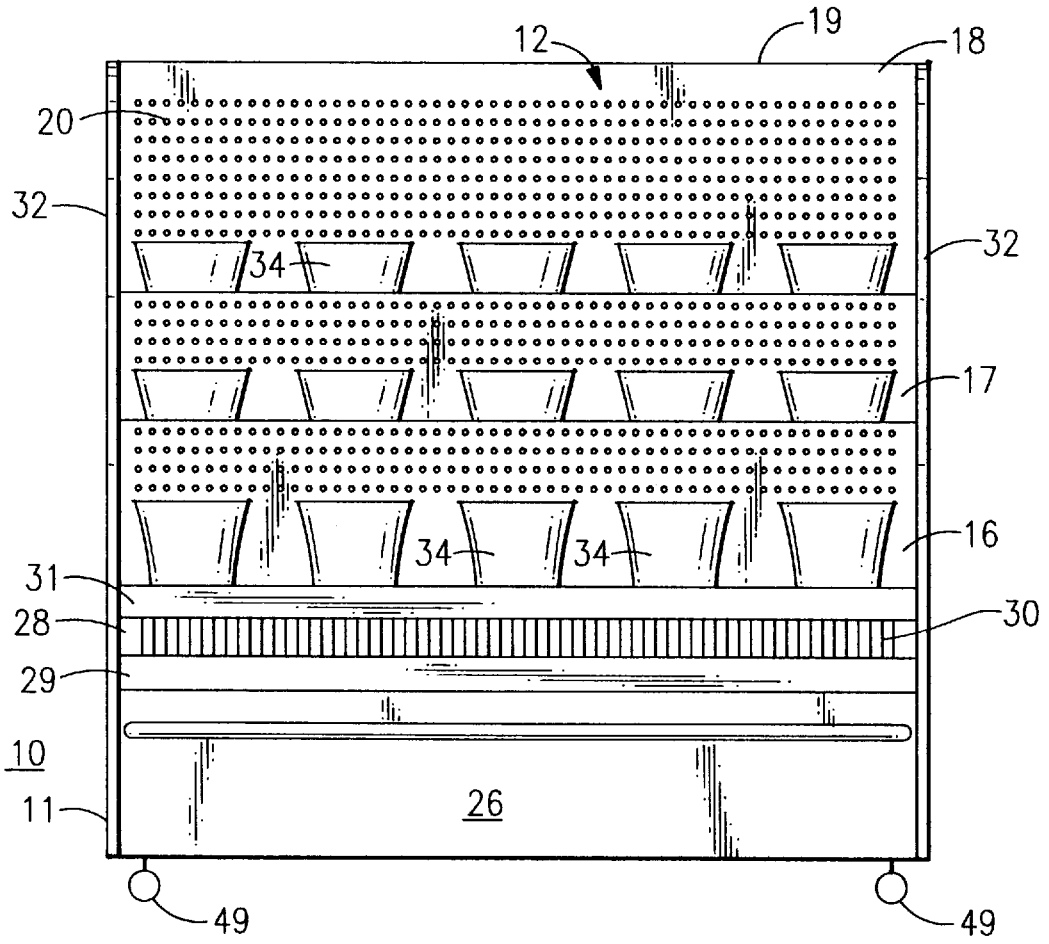
FIG. 3 is a front elevation of the unit of this embodiment.

With reference to the Drawing, and initially to FIG. 1 to 3, a floral display unit 10 or refrigerated merchandiser holds flowers (or other merchandise) for presentation to customers, and gently bathes the flowers with a flow of cool air. This keeps the cut flowers as fresh as possible. The floral display unit has an open front and open top to provide customers a better view of the flowers and improved access. This also improves store security, allowing store personnel to see over the unit. The open top creates a lower profile for the unit than would be possible otherwise, and permits natural or ambient room lighting to fall on the flowers. The open top also permits tall cut floral arrangements or other tall items to project above the top of the unit, if desired. For cut flowers, too low an air flow fails to keep the flowers covered in cool air, but too high an air flow creates turbulence, which can induce warm air from outside into the display case. High, turbulent flow can result in a high evaporation rate, which dries the flowers out.

The merchandiser has a case or cabinet 11 with a front open display portion 12, here shown with shelves or shelf members arranged in a staggered or stair step fashion, comprising a lowermost horizontal shelf 13, a middle shelf 14, and an upper shelf 15. There is a vertical riser wall 16 behind the shelf 13 and rising to the front of the shelf 14, and a vertical riser wall 17 behind the shelf 14 and rising to the front of the shelf 15. A third vertical riser wall 18 rises from the rear of the shelf 15 to the top 19 of the cabinet 11. In other embodiments, there can be more (or fewer) horizontal shelves. In each of the vertical riser walls 16, 17, and 18 there are a multiplicity of perforations 20 which serve as cold air supply openings. These perforations 20 are arranged in a two-dimensional grid or array on the vertical surface of each of the riser walls. The cold air flows non-turbulently out of the perforations and forward through the open display portion 12 of the cabinet 11.

The cabinet also has left and right side walls 22 and 24, and a front wall 26. In the front wall 26 there is a transverse recess 27 facing forward just below the lowermost shelf 13, with an undercut upper wall 28 and a downwardly slanted lower wall 29 that meets the undercut upper wall. A return air intake grille 30 is situated in the undercut wall 28. There is also a downwardly slanted, or chamfered front surface 31 at the front of the lowermost shelf 13.

At the side walls there are optional glass sides 32, which define left and right sides of the open display portion 12 of the unit. The sides 32 here have a curved edge that generally follows the streamline of the boundary layer between the cold air and the warmer ambient air. This curved edge generally approximates the shape of a quarter ellipse, but the actual shape can vary with the dimensions of the display portion 12. These sides can be clear, frosted, opaque, or may be mirrored, as desired. Also, by removing the sides 32, it is possible to butt two or more of these units 10 side by side to create a multiple-width floral display merchandiser.

As shown in FIGS. 2 and 3, there are vases or containers 34 for cut flowers, and these fit into round opening receptacles 35 formed in the shelves. Cut flowers can be placed in these vases 34, and water is maintained in them to provide moisture for their stems.

Figure 4:
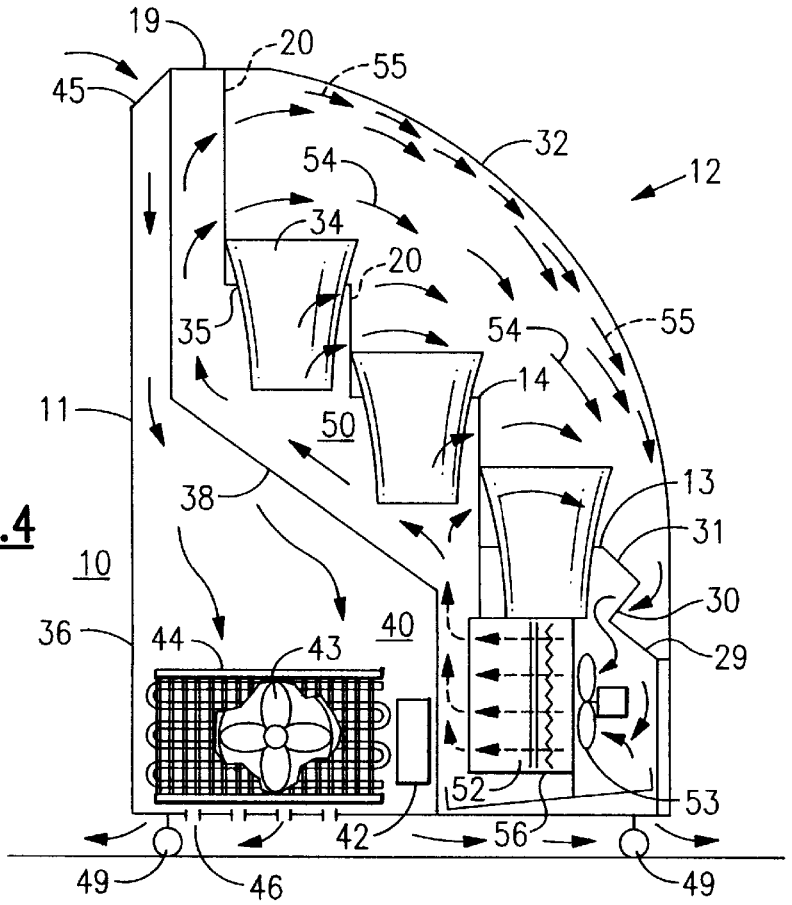
FIG. 4 is a cross-sectional view of the unit of this embodiment.

The internal construction and operation of the refrigerated display unit 10 of this embodiment can be explained with reference to the cross-sectional view of FIG. 4. Here a back wall 36 extends up to the top of the unit, and there is an insulated internal partition 38 that divides the interior space into a compressor equipment compartment 40 and a cold air pathway 50.

In the compartment 40 is located a refrigeration compressor 42 and a blower, which moves air downwards through a condenser coil 44. A condenser air intake grille 45 is located along a top edge of the cabinet, and here is angled downwards or chamfered. This allows the unit 10 to be pushed with the back 36 flush against a wall without obstructing condenser air flow, even if merchandise or other items are laid on the top 19 of the unit. The condenser air flows downwards to the compartment 40, and warm air from the condenser coil 44 is discharged out a vent 46 at the bottom of the unit 10. This disperses the warm exhaust air onto the floor, and does not disturb shoppers. Also shown on the bottom of the unit are wheels or casters 49 which permit the unit 10 to be easily positioned in the store. These wheels 49 also create a small clearance for the dispersal of the warm air exhausted from the condenser coil 44.

The cold air pathway 50 is defined between the partition 38 and the steps or shelves 13, 14, 15 and the riser walls 16, 17, 18. There is a layer of insulating material disposed on the partition 38. An evaporator coil or cooling coil 52 is positioned below the lowermost shelf 13 and adjacent the return air intake grille 30, and an evaporator fan 53 induces an air flow into the grille 30 and then moves the air through the evaporator coil 52. The evaporator coil 52 chills the air, which then proceeds upwards along the cold air pathway 50. The cold air then is discharged out the supply openings or perforations 20 on the vertical riser walls, and flows non-turbulently, generally as shown in arrows in FIG. 4, along a laminar flow path 54. A cold-air, warm-air interface, or boundary layer 55 is created at the outer edge of the laminar flow 54, which generally follows the quarter-ellipse edge profile of the glass sides 32 in this embodiment. The laminar flow path proceeds generally forward horizontally from the perforations 20, and then downwards in a gently curved path back to the return air intake grille 30. A high-performance filtration medium, such as a HEPA filter 56, can be positioned in the cold air pathway 50, e.g., in advance of the evaporator coil 52.

In this embodiment, the coldest air, that is, the air leaving the evaporator, contacts the undersides of the shelves 13, 14, 15, and the vases 34 filled with water, so that the shelves and the vases are kept chilled below ambient temperature and at the lowest temperature of the system. The cold air emanating from the array of perforations 20 therefore hugs the shelves and vases as it proceeds. The cold flow of air remains separated from the warmer ambient air, and maintains its laminar state until it reaches the return air intake grille 30. The cold air in the pathway 50 is also in contact with the lower part of the vases 34 which project down through the openings 35 beneath the shelves 13, 14, 15. This keeps the water cool within the vases 34, thereby helping to preserve the freshness of the flowers. The cold water acts as a thermal mass to keep the air temperature constant, even during the defrost cycle.

The evaporator coil is oversized, so as to minimize moisture removal, keeping the relative humidity relatively high. The refrigeration equipment is of a high-efficiency design, and automatically evaporates condensation without need for external heaters or drains. The refrigeration equipment is thermostatically controlled, with automatic defrost cycle.

The position of the return air intake grille 30 at the front of the cabinet 11 beneath the lowermost shelf 13 ensures that cold air stays within the boundary layer 55, and that the cold air is all returned to the evaporator coil 52. This prevents the cold air from spilling out of the case and being lost, which would cause warm air to be sucked in to replace it. Also, the downward slope shape of the walls 29 and 31, with the grille 30 being positioned on the undercut wall 28, ensures that any spillage or debris falls away from the return air intake and onto the floor of the store or shop, where it can be easily cleaned away. No debris or foreign matter lands in the evaporator drain pan.

While not shown in this embodiment, the unit 10 is typically provided with plugs or inserts for the openings 35 in the shelves so that the vases 34 can be removed, and the shelves (or portions of them) can be used for display of items other than cut flowers. The floral display unit of this embodiment is of modular design, and can be combined with other display units, either refrigerated or non-refrigerated. The unit 10 achieves a high merchandise display capacity with a smaller footprint than other refrigerated floral merchandisers. The cabinet 11 may have exterior slatwall on the sides or back, permitting shelving to be added, if desired. Optionally, a remote refrigeration system can be employed, or a different type of refrigeration system can be employed such as chilled water, or the unit can be configured with another similar unit in a master-slave or client-server configuration. The unit 10 can be provided in any of a variety of sizes, with some typical configurations being 15 vases (five vases per shelf, and three shelves) to 42 vases (fourteen vases per shelf, and three shelves), or with four or more shelves.

Of course, the refrigerated display units of this invention are not limited to merchandising flowers. These can be used or configured for other products, such as fresh produce, cheeses, and other perishable. By configuring the unit for lower or freezing temperatures, the display units can be used for frozen products, such as frozen desserts.

It is also possible to adapt the refrigerated display unit for filtration of the airflow, e.g., by incorporating a HEPA filter, as a means for reducing microbial airborne contamination of foodstuffs and fresh cut products. This reduces contamination from bacteria, mold spores, or other airborne contaminants. The laminar airflow and its boundary layer serve to keep the recirculating air separated from the ambient air, and thereby allow the recirculating air to be HEPA filtered. This keeps the merchandise in a very clean, contamination-free environment, while presenting the merchandise in an attractive open and pleasantly displayed arrangement.

While the invention has been described here with reference to a preferred embodiment, the invention is not limited only to that embodiment. Rather, many modifications and variations will be apparent to those skilled in the art, without departing from the scope and spirit of this invention, as defined in the appended claims.

I claim:

1. Refrigerated open display case for flowers or other merchandise, with laminar flow bounty layer, comprising a cabinet having a back, sides and an open front display portion, the font display portion including a plurality of horizontal shelf members arranged in parallel staggered stair-step fashion, and a plurality of vertical riser walls disposed respectively behind said shelf members and between successive ones of said shelf members; and air cooling means within said cabinet for producing a continuous laminar flow of chilled air over said shelf members, including a return air intake disposed across said cabinet below a front of a lowermost one of said shelf members; chilling air that enter said return air intake; a plurality of chilled air supply openings arranged across each of said vertical riser walls for discharging said chilled air in a laminar flow path over said shelves towards said return air intake; and means for moving air from said return air intake through said chilling means to said chilled air supply openings;

wherein said return air intake comprises a recess facing forward and extending transversely below the front of said lowermost shelf member and having an undercut transverse wall, with a return air grille being disposed in said undercut transverse wall.

2. Refigerated open display case according to claim 1, wherein said means for moving air includes a cold air tunnel defined between said shelf members and a partition disposed beneath said shelf members such that air leaving said chilling means passes in contact with the underside of said shelf members.

3. Refrigerated open display case according to claim 2, further comprising a plurality of vase members for holding cut flowers and water for said cut flowers, and wherein said shelf members have opening therethrough adapted for receiving said vase members such that a lower portion of each said vase member protrudes through the respective shelf member and is in contact with the air leaving said chilling means.

4. Refrigerated open display case according to claim 3, wherein said vase members have water in the portions thereof that protrude through the shelf members to serve as a heat sink and maintain refrigeration of the air during a defrost cycle of said chilling means.

5. Refrigerated open display case according to claim 1, wherein each said vertical riser wall has said supply openings evenly distributed in a two-dimensional array across the vertical riser wall.

6. Refrigerated open display case according to claim 1, further comprising a side wall disposed on at least one side of the cabinet and defining a lateral limit to said open front display portion.

7. Refrigerated open display case according to claim 6, wherein said side wall has a generally quarter-elliptical profile.

8. Refrigerated open display case according to claim 6, wherein said side wall has an upper periphery that conforms with the air flow pattern from an uppermost of said vertical riser walls to said return air intake.

9. Refrigerated open display case for flowers or other merchandise, with laminar flow boundary layer, comprising a cabinet having a back, sides and an open front display portion the front display portion including a plurality of horizontal shelf members arranged in parallel staggered stair-step fashion, and a plurality of vertical riser walls disposed respectively behind said shelf members and between successive ones of said shelf members; and air cooling means within said cabinet for producing a continuous laminar flow of chilled air over said shelf members, including a return air intake disposed across said cabinet below a front of a lowermost one of said shelf members; chilling means for chilling air that enters said return air intake; a plurality of chilled air supply opening arranged across each of said vertical riser walls for discharging said chilled air in a laminar flow path over said shelves towards said return air intake; and means for moving air from said return air intake through said chilling means to said chilled air supply openings;

wherein said return air intake comprises a recess extending transversely below the front of said lowermost shelf member and having an undercut transverse wall, with a return air grille being disposed in said undercut transverse wall; and wherein said lowermost shelf member has a chamfered front portion above said return air intake.

10. Refrigerated open display case according to claim 9, wherein the transverse recess of said return air intake further includes a slanting lower wall meeting said undercut transverse wall, such that debris falling on said return air intake falls forward out of the return air intake.

11. Refrigerated open display case for flowers or other merchandise, with laminar flow boundary layer, comprising a cabinet having a back, sides and an open front display portion, the front display portion including a plurality of horizontal shelf members arranged in parallel staggered stair-step fashion, and a plurality of vertical riser walls disposed respectively behind said shelf members and between successive ones of said shelf members; and air cooling means within said cabinet for producing a continuous laminar flow of chilled air over said shelf members, including a return air intake disposed across said cabinet below a front of a lowermost one of said shelf members; chilling means for chilling air that enters said return air intake; means for contacting the chilled air leaving said chilling means with undersides of said shelf members; a plurality of chilled air supply openings arranged in a two-dimensional array across each of said vertical riser walls for discharging said chilled air horizontally in a laminar flow path over said shelves such that the chilled air proceeds non-turbulently across the associated shelf and falls towards said return air intake; and means for moving air from said return air intake through said chilling means to said chilled air supply openings;

wherein said return air intake comprises a recess extending transversely below the front of said lowermost shelf member.

12. Refrigerated open display case for flowers or other merchandise, comprising a cabinet having a back, sides and an open front display portion, the front display portion including at least one horizontal shelf member; and air cooling means within said cabinet for producing a continuous laminar flow of chilled air over said at least one shelf member, including a return air intake disposed across said cabinet below a front of said at least one shelf member; chilling means for chilling air that enters said return air intake; a plurality of chilled air supply openings arranged for discharging said chilled air in a flow path over said at least one shelf member towards said return air intake; and means for moving air from said return air intake through said chilling means to said chilled air supply openings;

wherein said return air intake comprises a recess facing forward and extending transversely below the front of said at least one shelf member and having an undercut transverse wall, with a return air grille being disposed in said undercut transverse wall.

13. Refrigerated open display case for flowers or other merchandise, comprising a cabinet having a back, sides and an open front display portion, the front display portion including at least one horizontal shelf member; and air cooling means within said cabinet for producing a continuous laminar flow of chilled air over said at least one shelf member, including a return air intake disposed across said cabinet below a front of said at least one shelf member; chilling means for chilling air that enters said return air intake; a plurality of chilled air supply openings arranged for discharging said chilled air in a flow path over said at least one shelf member towards said return air intake; and means for moving air from said return air intake through said chilling means to said chilled air supply openings;

wherein said return air intake comprises a recess extending transversely below the front of said at least one shelf member and having an undercut transverse wall, with a return air grille being disposed in said undercut transverse wall; and wherein said shelf member has a chamfered front portion above said return air intake.

14. Refrigerated open display case according to claim 13, wherein the transverse recess of said return air intake further includes a slanting lower wall meeting said undercut transverse wall, such that debris falling on said return air intake falls forward out of the return air intake.

* * * * *

UNITED STATES PATENT AND TRADEMARK OFFICE

CERTIFICATE OF CORRECTION

PATENT NO. : 5,860,289

DATED : Jan. 19, 1999

INVENTOR(S) : Michael L. Wetzel

It is certified that error appears in the above-identified patent and that said Letters Patent is hereby corrected as shown below:

Col 1, line 8:
"lamninar" should read --laminar--

Col. 6, line 12:
"bounty" should read --boundary--

Col. 6, line 14:
"font" should read --Front--

Col. 6, line 22:
"members; chilling air that enter" should read
--members; chilling means for chilling air that enter--

Col. 6, line 43 and Col. 7, line 15:
"opening" should --openings--

Col. 7, line 4:
--insert a comma (,) after the first occurrence of portion--

Col. 7, line 15:
"opening" should read --openings--

Signed and Sealed this

Eighteenth Day of May, 1999

*Attest:*

Q. TODD DICKINSON

*Attesting Officer*

*Acting Commissioner of Patents and Trademarks*